United States Patent [19]

Fronheiser

[11] Patent Number: 4,835,021

[45] Date of Patent: May 30, 1989

[54] COATING PROCESS

[75] Inventor: Dennis R. Fronheiser, Rochester, N.Y.

[73] Assignee: Eastman Kodak Company, Rochester, N.Y.

[21] Appl. No.: 190,802

[22] Filed: May 6, 1988

[51] Int. Cl.[4] ..... B05D 3/02

[52] U.S. Cl. ..... 427/393.5; 118/410; 427/407.1; 427/412.1; 430/935

[58] Field of Search ..... 118/410; 427/393.5, 427/407.1, 412.1; 430/935

[56] References Cited

U.S. PATENT DOCUMENTS

| | | | |
|---|---|---|---|
| 3,206,323 | 9/1965 | Miller et al. | 117/34 |
| 4,001,024 | 1/1977 | Dittman | 96/87 |
| 4,719,132 | 1/1988 | Porter, Jr. | 427/409 |
| 4,745,011 | 5/1988 | Fukata et al. | 427/426 |

OTHER PUBLICATIONS

Saunders, J. H. et al, *Polyurethanes Chemistry & Technology*, pp. 231–233, 464, 1983.

*Primary Examiner*—Michael Lusignan
*Attorney, Agent, or Firm*—William J. Davis

[57] ABSTRACT

A method of continuously forming on a moving film web a uniform, tack-free coating of a crosslinked, thermoset polymer resulting from the reaction between reactive fluid components by means of a laminar flow extrusion coating hopper wherein the reactive components are continuously fed through separate chambers to the surface of the moving film where component mixing sufficient to achieve crosslinking between the active components is initiated.

5 Claims, 1 Drawing Sheet

COATING PROCESS

FIELD OF THE INVENTION

This invention relates to a method for applying to a plastic film a reactive coating composition and, more particularly, to a method for coating a crosslinkable clearcoat over a basecoat paint layer on the film.

BACKGROUND

The application of clear top coats over basecoat paint layers is becoming increasingly, popular in the automotive industry. In such a color-plus-clear or basecoat/-clearcoat system the pigmented basecoat is sprayed on the automotive panel and is overcoated with a reactive clear composition which crosslinks and hardens after being sprayed and dried. For example, the recent patent to Simpson et al U.S. Pat. No. 4,681,811, describes a transparent topcoat formed by spraying over the paint layer a liquid crosslinkable composition comprising a polyepoxide and a polyacid curing agent. According to the patent, this provides a composite with outstanding gloss and distinctness of image.

Simpson et al give no suggestion that any problems result from mixing the components of the clearcoat composition well in advance of spraying the mixture.

Another kind of clear top coat composition for application by spraying is described by Ambrose et al. U.S. Pat. No. 4,699,814. This contains a low molecular weight epoxy-functional polyurethane obtained by reacting an isocyanate with a hydroxy polyepoxide. A polyacid curing agent is used. Again no problem is indicated with mixing the components well before the mixture is applied.

Recently a new process for applying paints and clearcoats to automobile bodies and other three dimensional articles which yields finishes of outstanding quality has been described in Reafler U.S. Patent Application Ser. No. 116,426, filed Nov. 3, 1987. The new process involves manufacture of a stretchable plastic film, then coating one side of the film by laminar flow with a pigmented basecoat, thereafter applying a clearcoat over the basecoat and applying an adhesive layer to the other side of the film. The coating technique used for optimum quality involves the continuous laminar flow coating of a moving web of the plastic film by contact with a horizontally extending bead of the liquid coating composition. The latter is extruded from the slot of an extrusion coating hopper.

Extrusion coating hoppers have been used previously in precision coating of photographic goods, as disclosed, for example, in Miller et al, U.S. Pat. No. 3,206,323. They can produce coatings having exceptional smoothness, gloss and other good qualities. They are, however, more sensitive to problems with the feed composition than is the conventional spray painting method of applying clearcoats to automobile bodies. Thus, it has been found that the clearcoat compositions begin to increase in viscosity soon after the components are mixed. The extrusion hopper coating method may produce coatings of less than optimum quality if the viscosity of the feed composition increases substantially during the coating operation.

It has also been found that after the components of the clearcoat are mixed in the supply vessel, heterogeneous particles or slugs of polymer may begin to form. These tend to stick to the metal in and around the hopper exit slot and cause line defects in the coatings.

Evidently neither of these phenonmena cause problems in the spraying of clearcoat compositions, possibly because the high shear of the spray nozzles lowers the viscosity of the coating composition.

According to Hayward, Reafler and Schuler, U.S. Ser. No. 189,090, entitled "Coating Process", filed May 2, 1988, as a continuation in-part of Reafler Ser. No. 116,426, the coating of reactive clearcoats on films through the slot of a coating hopper can be improved by mixing the components of the clearcoat shortly before the composition is fed to the coating hopper.

BRIEF SUMMARY OF THE INVENTION

The method of this invention provides a further improvement in the forming of a uniform coating of a crosslinked, thermoset polymer on a moving film web. The method comprises continuously feeding first and second reactive fluid components of the coating composition to separate chambers of an extrusion hopper having an upstream chamber and a downstream chamber which converge toward a horizontal extrusion slot terminating in an orifice in close proximity to but spaced from the surface of the moving film. Physical contact between the components is delayed until they converge at the orifice, where vortical mixing occurs sufficiently to initiate crosslinking between the components. The resulting mixture is continuously flowed from the orifice as a uniform layer on the moving film web where upon drying the layer is converted to a crosslinked, tack-free condition.

Whereas in the spray drying of clearcoats the components are mixed a substantial period of time before spraying them, and whereas such interim time can be shortened by the method described in the aforementioned Hayward et al, U.S. Patent Application, Ser. No. 189,090, applicant has found that when the mixing of the clearcoat components is further delayed until the very moment they emerge in the form of separate streams from the delivering coating hopper, a premature viscosity increase in the coating composition is avoided altogether. In addition, applicant has found unexpectedly that the degree of mixing required for providing a crosslinked tack-free clearcoat layer is achieved by the vortical mixing action in the coating bead.

A proper combination of parameters, selected as exemplified hereinafter, ensures mixing of the converging components at the orifice by vortical action within the coating bead sufficiently to initiate crosslinking between the components. The resulting mixture then continuously flows onto the moving basecoat layer to form a uniform layer which is converted to a crosslinked, thermoset, tack-free condition during the subsequent drying cycle.

In a specific embodiment, the first reactive fluid component has a lower viscosity than the second reactive component and is fed to an upstream hopper chamber at a relatively low flow rate, while the second reactive component is fed to a downstream chamber at a relatively higher flow rate.

The terms "upstream chamber" and "downstream chamber" as used herein refer to positions of the chambers relative to the direction of the arriving and leaving portions of the film web, respectively.

THE DRAWINGS

The invention will be further described with reference to the drawings of which

DETAIL DESCRIPTION

Figure 1:
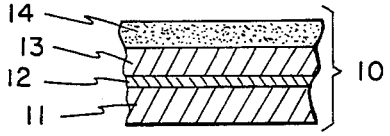
FIG. 1 is a diagrammatic cross section of a coated film made by the method of the invention.

FIG. 1 is diagrammatic cross-sectional side view, not to scale, of a flexible and strechable sheet material or film 10 of the kind described in the above-cited patent application of G.G. Reafler. The film 10 comprises a thin flexible carrier film 11 which is an essentially planar, self-supporting, stretchable, thermoplastic polymeric film.

Suitable polymeric materials for the carrier film 11 include stretchable thermoplastic polymers having heat softening and tensile elongation properties which are suitable for thermoforming or vacuum forming processes. Especially useful are the stretchable blended compositions disclosed in the patent to Weemes et al U.S. Pat. No. 4,582,876.

Coated on the carrier film 11 is a basecoat or paint layer 13 which has a mean dry thickness in the range from about 0.012 to 0.080 millimeters and, preferably, from about 0.020 to 0.060 millimeters. The paint layer is formed by laminar flow coating of a basecoat composition of the types used for flexible automotive finishes. The preferred compositions are aqueous dispersions of a film-forming binder resin and pigment with one or more organic solvents which serve as coalescing agents or the like.

Although not essential in all cases, a thin bonding layer or tie coat 12 can be coated and dried on the carrier film before the paint layer is coated in order to improve the bonding of the paint layer to the carrier film. This layer preferably has a dry thickness not greater than about 0.0025 millimeter, and thus is much thinner than the dried basecoat.

The next layer, i.e., the crosslinked clearcoat layer 14 of FIG. 1, is the layer to which the method of the present invention particularly applies. Crosslinkable clearcoat compositions for coating over basecoats are known in the art. They are transparent and comprise (a) as one component, a crosslinkable polymer such as a polyester polyol, a polyurethane polyol, or an acrylic polyol and (b) as a second component, a crosslinking agent such as a polyisocyanate. Each component is dissolved to a suitable viscosity for extrusion coating in a volatile organic solvent such as toluene.

Figure 2:
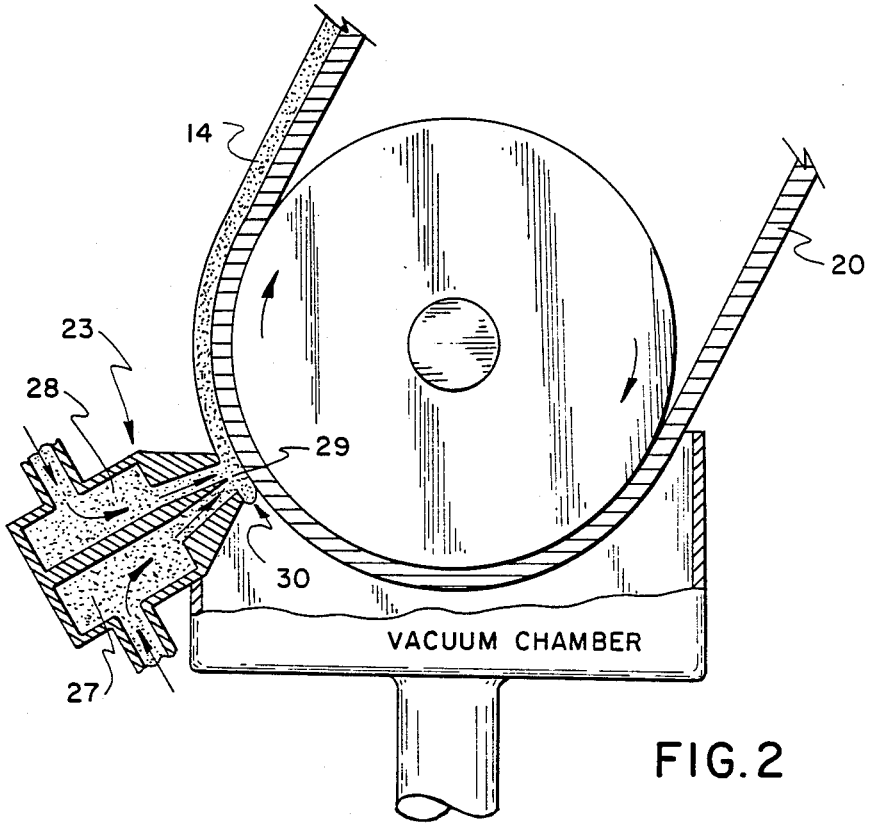
FIG. 2 is diagrammatic side view of apparatus with which the method of the invention can be carried out.

FIG. 2 illustrates schematically the method of the invention and one form of apparatus for practicing it. A web of paint-coated film 20 is fed from a supply roll (not shown) opposite a hopper coating station 23. The latter comprises a slotted dual extrusion hopper of known design, e.g., as shown in the patent to Miller et al, U.S. Pat. No. 3,206,323. The reactive clear coat components are separately fed from supply vessels (not shown) to upstream hopper chamber 27 and downstream hopper chamber 28 which converge toward an extrusion slot 29. The latter terminates in orifice 30 in close proximity to but spaced from the surface of the paint coated web 20 and applies the mixed streams to the paint coated film 20 as clearcoat layer 14.

Figure 3:
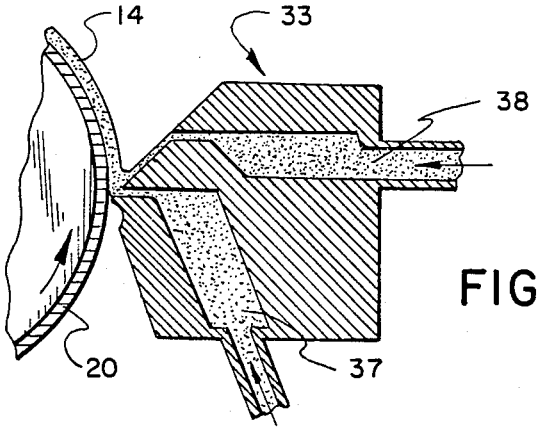
FIG. 3 is a diagrammatic side view of an alternative hopper design suitable for use in the method of this invention.

FIG. 3 illustrates an alternative coating hopper 33 for which the method of the invention can also be adapted. This hopper is formed of a slide/extrusion combination of known design, e.g., as shown in Russell U.S. Pat. No. 2,761,417. In this case, continuous streams of each of the reactive clearcoat components are similarly delivered separately via upstream and downstream chambers 37 and 38, respectively, to the vortex of hopper 33. The mixture formed in the vortex is applied to the surface of the moving web of paint-coated film 20 to form clearcoat layer 14.

Thus, the particular means used for delaying contact between the reactive components of the clearcoat composition until their separate arrival at the hopper/surface interface can be selected from a number of possible coating devices. The main requirements are that (a) the device should maintain physical separation between the components during their delivery to and dwell time in the coating device, and (b) the components should be delivered in separate streams to the coating hopper orifice such that effective vortical mixing can take place prior to the flowing of the resulting mixture from the orifice as a uniform layer on the moving carrier film.

The clear polymeric layer produced by the method of this invention has a mean dry thickness in the range from about 0.020 to about 0.090 millimeters and, preferably, from about 0.030 to about 0.075 millimeters.

If desired, a plurality of superimposed clearcoat layers as described herein can be applied by either a single- or multiple-pass coating method.

Vortical mixing sufficient to achieve crosslinking can be attained by appropriately selecting the combination of viscosities, temperatures and flow rates of the reactive fluid components, the coating speed, pressure differential applied across opposite surfaces of the coated film web as described, e.g., by Beguin in U.S. Pat. No. 2,681,294 and Miller et al in U.S. Pat. No. 3,206,323; and hopper spacing between the extrusion slot and the surface being coated. Other variables such as the type and quantity of solvents and of optionally present addenda such as surface active agents, and the like; and the surface characteristics of the underlying base coat can also influence the degree or rate of mixing.

Parameter selections can be made by routine experimentation and adjustment of variables. For example, increasing the viscosity and/or flow rate of the component fed into the upstream hopper chamber relative to the viscosity and flow rate of the component fed into the downstream chamber tends to reduce the degree of component mixing required for good crosslinking.

The method of this invention has a number of significant advantages as compared with the prior art method of coating initially reactive components onto the surface of a moving web. Thus, for example, since the reactive coating components do not make physical contact with each other until after their passage through the coating hopper, no in-hopper clogging of the coating composition due to crosslinking during work stoppage can occur. Such clogging can require tedious and time consuming disassembly and cleaning of the coating hopper, as well as lead to expensive equipment downtime.

It is known to form unmixed, multilayer coatings by feeding separate streams of a fluid coating composition onto a moving substrate via an extrusion hopper having separate chambers that converge at the hopper lip.

For example, Miller et al U.S. Pat. No. 3,206,323 describes the use of such a hopper for making dual-layer coatings from separately supplied fluid compositions having different viscosities.

It is also known that a small degree of intermixing of simultaneously applied coating compositions can take place. For example, Dittmann et al U.S. Pat. No. 4,001,024 notes the occurrence of "tolerable" interlayer mixing during the application of compositions that are intended to retain a distinct layer relationship.

However, neither of the above cited references gives an indication of the desirability of deliberate and throrough vortical mixing of separately supplied reactive coating components of the types described in this invention.

While the method of this invention is useful in any instance where it is desired to delay contact between reactive coating components until their separate arrival at a moving film web surface to be coated, it is especially useful in the manufacture of thermoformable basecoat/clearcoat laminates used in the automotive industry and is therefore being described herein with reference to the coating of such elements. The process of the invention can be practiced with a wide range of reactive, crosslinkable clearcoat compositions that are prepared by mixing two or more reactive components at the time of their application onto a moving substrate. The process is especially useful for coating reactive compositions that are suitable for forming a flexible clearcoat over a basecoat on a carrier film to obtain a flexible and stretchable sheet material as in the cited Reafler patent application.

Examples of such compositions include crosslinking polyurethane film-forming compositions which are formed by the reaction of a crosslinkable urethane polymer with a crosslinking agent. One such composition is the solvent-based system comprising a polyurethane polyol as one component and a polyisocyanate as the other, as disclosed in the patent to Porter, U.S. Pat. No. 4,719,132. Especially preferred is a two-component composition disclosed in the patent, of which one component comprises a crosslinkable poly(ester-urethane) polyol and the other comprises a polyisocyanate crosslinking agent such as a polyfunctional aliphatic isocyanurate of 1,6-hexamethylene diisocyanate.

Another useful clearcoat composition is the crosslinking epoxy-functional polyurethane which is prepared by reacting an isocyanate with a hydroxyl-functional polyepoxide having two or more epoxy groups per molecule, then mixing the resulting product with a curing agent such as a polyacid, anhydride, and/or polyamine and curing the coated mixture, as described in the patent to Ambrose et al, U.S. 4,699,814. Other examples include the crosslinkable epoxy polymers, such as epoxy-containing acrylic polymers, that are mixed with a polyacid curing agent, such as the half-ester reaction products of a polyol and a carboxylic acid anhydride, as disclosed in the patents to Simpson et al, U.S. Pat. No. 4,650,718; Singer et al, U.S. Pat. No. 4,681,811; and Singer et al, U.S. Pat. No. 4,703,101. All of the cited patents are incorporated by reference herein.

Coating composition additives such as UV absorbers and/or stablilizers, flow control agents, antioxidants, plasticizers, and the like can also be added, if desired, to either one or both of the clearcoat components.

EXAMPLE I

The clearcoat components whose compositions are described below were continuously fed to an extrusion hopper as illustrated in FIG. 2 in such a manner that the less viscous Component A was received by upstream chamber (27) and the more viscous Component B was received by the downstream chamber (28). The flow rates were 0.96 cubic cm/sec and 4.58 cubic cm/sec, respectively. The components remained separated until their convergence at the extrusion slot 29 where initiation of the desired crosslinking occurred by means of vortical mixing of the components at orifice 30. The continuously forming polymeric layer was dried by passage through an air-heated drying chamber to provide a tack-free smooth clearcoat of excellent quality.

| Composition of Components | Approx. % Weight |
|---|---|
| Component A | |
| Urethane Resin | 60 |
| Toluene | 30 |
| Benzotriazole (diluted to 58% solids with toluene) | 1 |
| Component B | |
| Polyfunctional aliphatic isocyanurate resin based on 1.6 hexamethylene diisocyanate (diluted to 85% solids with toluene) | 100 |

COMPARISON EXAMPLE

A modification of the above described procedure consisting of inverting the component supply such that the less viscous Component A was received by downstream chamber (28) and the more viscous Component B was received by upstream chamber (27) led to a tacky clearcoat of unacceptable quality.

EXAMPLE II

A tack-free clearcoat of excellent quality was produced by continuously supplying Component (A) having a viscosity of 30 mPa. sec and a temperature of 20 degrees C. to the upstream hopper chamber (27) at a flow rate of 0.96 cubic cm/sec and Component (B) having a viscosity of 90 mPa. sec and a temperature of 20 degrees C. to the downstream hopper chamber (28) at a flow rate of 4.85 cubic cm/sec, while maintaining a coating (web) speed of 0.508 m/sec, a pressure differential across the opposite surfaces of the coated film web of 4,900 dynes/cm2, and a hopper spacing of 0.025 cm, followed by drying the clearcoat layer in a drying zone at an average temperature of 77 degrees C for 6 minutes.

The invention has been described in detail with particular reference to preferred embodiments thereof, but it will be understood that variations and modifications can be effected within the spirit and scope of the invention.

I claim:

1. A method of continuously forming on a moving film web a uniform coating of a crosslinked, thermoset polymer resulting from the reaction between first and second reactive fluid components which comprises continuously feeding the reactive components to separate chambers of an extrusion hopper having an upstream chamber and a downstream chamber which converge toward a horizontal extrusion slot terminating in an orifice in close proximity to but spaced from the surface of the moving film, delaying physical contact between the components until they converge at the orifice, mixing the components at the orifice sufficiently to initiate crosslinking between the components, continuously flowing the resulting mixture from the orifice as a uniform layer on the moving carrier film web and drying the layer to a crosslinked, tack-free condition.

2. The method according to claim 1, wherein the first reactive fluid component has a lower viscosity than the second reactive fluid component and is fed to the upstream chamber, and the second reactive fluid component is fed to the downstream chamber.

3. The method according to claim 2, wherein the first reactive fluid component comprises a crosslinkable polyurethane in a volatile solvent, and the second reactive fluid component comprises a solution of a crosslinking agent.

4. The method according to claim 1, wherein the combination of viscosities, temperatures and flow rates of the first and the second reactive fluid components, coating speed, pressure differential, and hopper spacing are selected to cause thorough mixing of the reactive fluid components at the hopper orifice.

5. The method according to claim 3 wherein the coating is formed as a clearcoat over a basecoat paint layer on a carrier film web.

* * * * *